United States Patent [19]

Nielsen

[11] Patent Number: 4,972,924

[45] Date of Patent: Nov. 27, 1990

[54] MODULAR SCAFFOLDING GANTRY

[76] Inventor: Neil M. Nielsen, 636 Progress Road, Wacol, Australia, 4076

[21] Appl. No.: 17,168

[22] Filed: Feb. 20, 1987

[30] Foreign Application Priority Data

Feb. 20, 1986 [AU] Australia ..... PH4708
Jan. 2, 1987 [AU] Australia ..... PH9734

[51] Int. Cl.[5] ..... E04G 1/34

[52] U.S. Cl. ..... 182/152; 182/179; 52/69; 24/514

[58] Field of Search ..... 182/178, 179, 187, 129, 182/128, 113; 52/69; 24/514

[56] References Cited

U.S. PATENT DOCUMENTS

| | | | |
|---|---|---|---|
| 2,419,145 | 4/1947 | Kersenbrock | 182/187 |
| 2,462,429 | 2/1949 | Sachs . | |
| 2,593,122 | 4/1952 | Droeger et al. . | |
| 2,744,794 | 5/1956 | Sheard | 182/152 |
| 3,037,588 | 6/1962 | Causey . | |
| 3,121,470 | 2/1964 | Stone | 182/178 |
| 3,190,405 | 6/1965 | Squire | 182/178 |
| 3,566,991 | 3/1971 | Provix | 182/179 |
| 4,222,459 | 9/1980 | Hard | 182/152 |

FOREIGN PATENT DOCUMENTS

| | | | |
|---|---|---|---|
| 1137770 | 11/1982 | Australia . | |
| 1504752 | 5/1983 | Australia . | |
| 901353 | 7/1962 | United Kingdom | 182/179 |
| 969525 | 1/1980 | United Kingdom . | |

*Primary Examiner*—Reinaldo P. Machado
*Attorney, Agent, or Firm*—Wood, Dalton, Phillips, Mason and Rowe

[57] ABSTRACT

A gantry module which may be transported to a building site and simply placed on site to provide protection for pedestrians. Each gantry module is adapted to be secured to adjacent similar modules to provide a gantry assembly. In addition clamp means perform the dual function of securing adjacent modules and also securing a removable hand rail to the assembly. The modules are of generally rectangular form but may be of any desired shape and may include folding legs to enable transportation of a large number of modules.

14 Claims, 10 Drawing Sheets

MODULAR SCAFFOLDING GANTRY

This invention relates to improvements to scaffolding and in particular to an improved scaffolding gantry suitable particularly for erection on a footpath say to allow pedestrian passage thereunder but to protect pedestrians from possible falling debris associated with building construction or demolition.

Commonly, scaffolding gantries are formed from a plurality of scaffolding elements including a number of upright pipe members and a plurality of ledgers which are interconnected in such a fashion as to form on a footpath a passageway or tunnel through which pedestrians may pass. The conventional type of scaffolding gantry as above has a number of disadvantages. In particular, the footpath area upon which the scaffolding is to be erected has to be hired from the relevant Local Authority from the commencement of the erection of the gantry and as erection often takes up to four weeks, four weeks' hire of the footpath is required before erection or demolition of a building can commence. Furthermore as an extended erection period is required, labour costs are particularly high and the scaffolding gantry if not satisfactory to the relevant authorities, may require to be disassembled and re-erected after inspection.

Normally scaffolding gantries of the above form are assembled from a plurality of scaffolding components which are simply dumped on site and after completion of a buildingwork, those components are required to be disassembled, repaired if necessary and delivered back to the hirer thereof and costs are often associated with repair of such components or replacement thereof in the event of missing components.

The present invention aims to overcome or alleviate at least some of the above disadvantages by providing an improved scaffold gantry assembly and in particular a gantry assembly of modular form which may be arranged on site rapidly and efficiently and which therefore requires minimum costs for assembly. The present invention also aims to provide a gantry which is safe in use and constructed of a minimum number of components so as to avoid losses associated with the conventional type of gantry.

In one preferred form, the gantry assembly of the present invention comprises a plurality of gantry modules each being preferably of a rectangular form and comprising a plurality of upstanding support members or legs and a roof assembly secured to and supported by the upstanding legs. Suitably a plurality of such gantry modules are arranged in end to end relationship with suitable means provided to interconnect the adjacent legs. Preferably also each leg is provided with a foot assembly which may be adjusted to suit varying footpath undulations or heights. Preferably the upstanding members are foldable to enable modules to be stacked for transport. Other objects and advantages of the invention will become apparent from the following description.

In order that the invention may be more readily understood and put into practical effect, reference will now be made to the accompanying drawings which illustrate a preferred embodiment of the invention and wherein.

Figure 1:
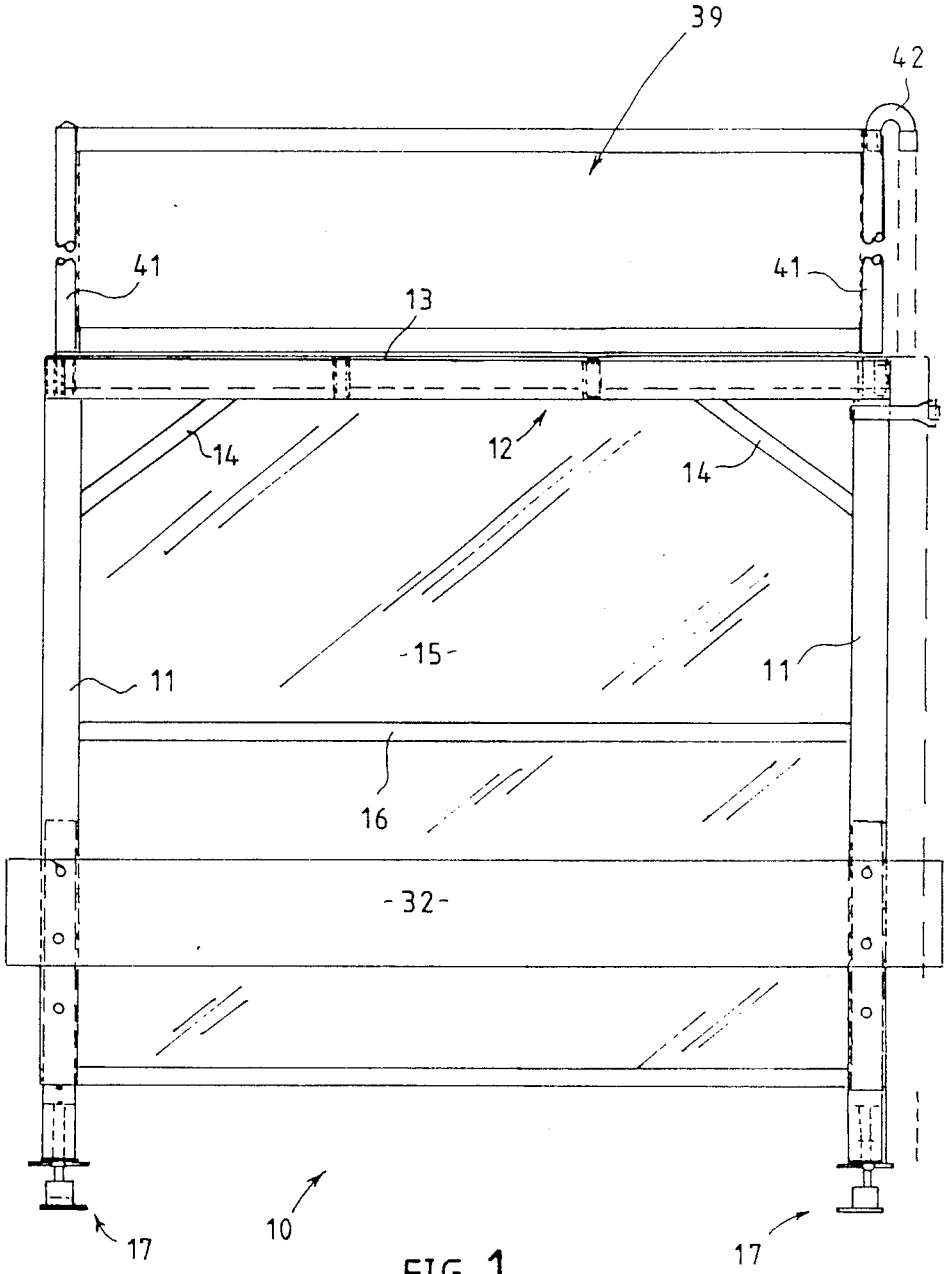
FIG. 1 is an elevational view of one form of gantry assembly according to the present invention.
Figure 2:
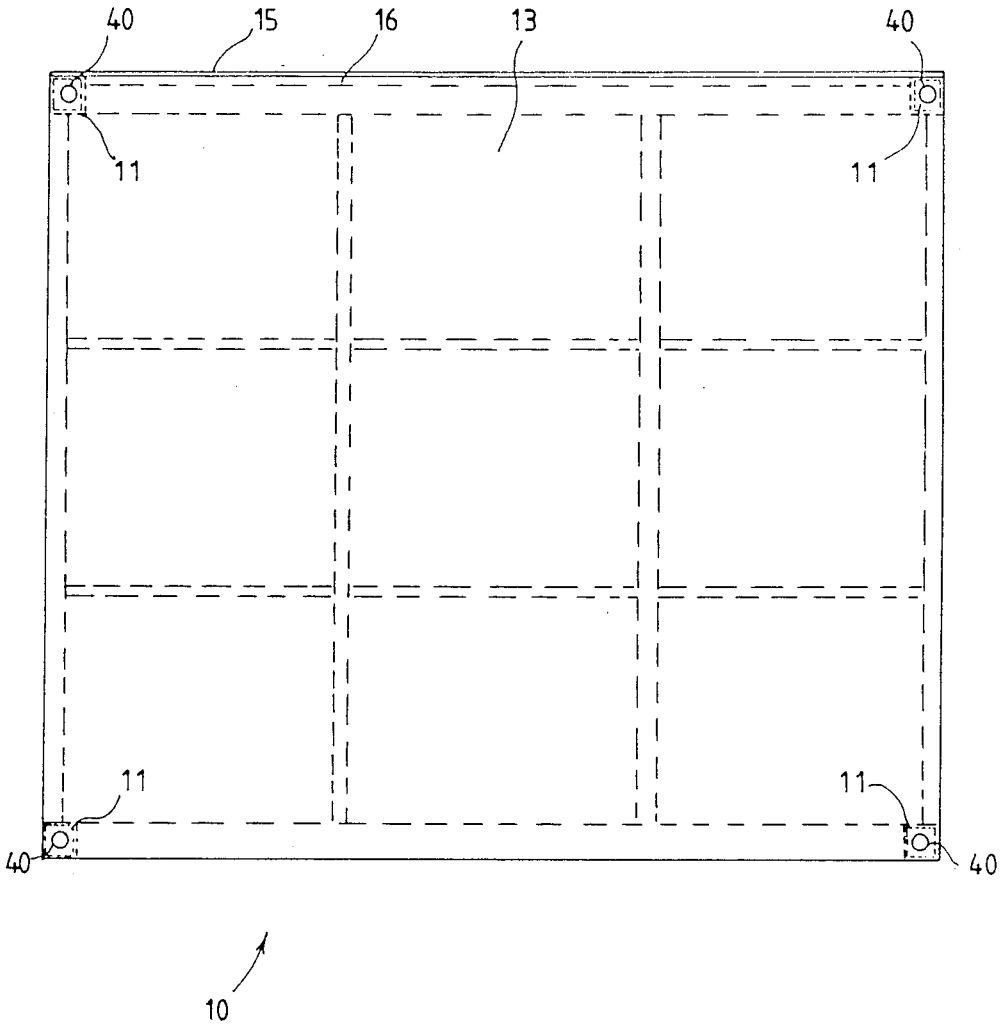
FIG. 2 is a plan view of the gantry of FIG. 1.
Figure 3:
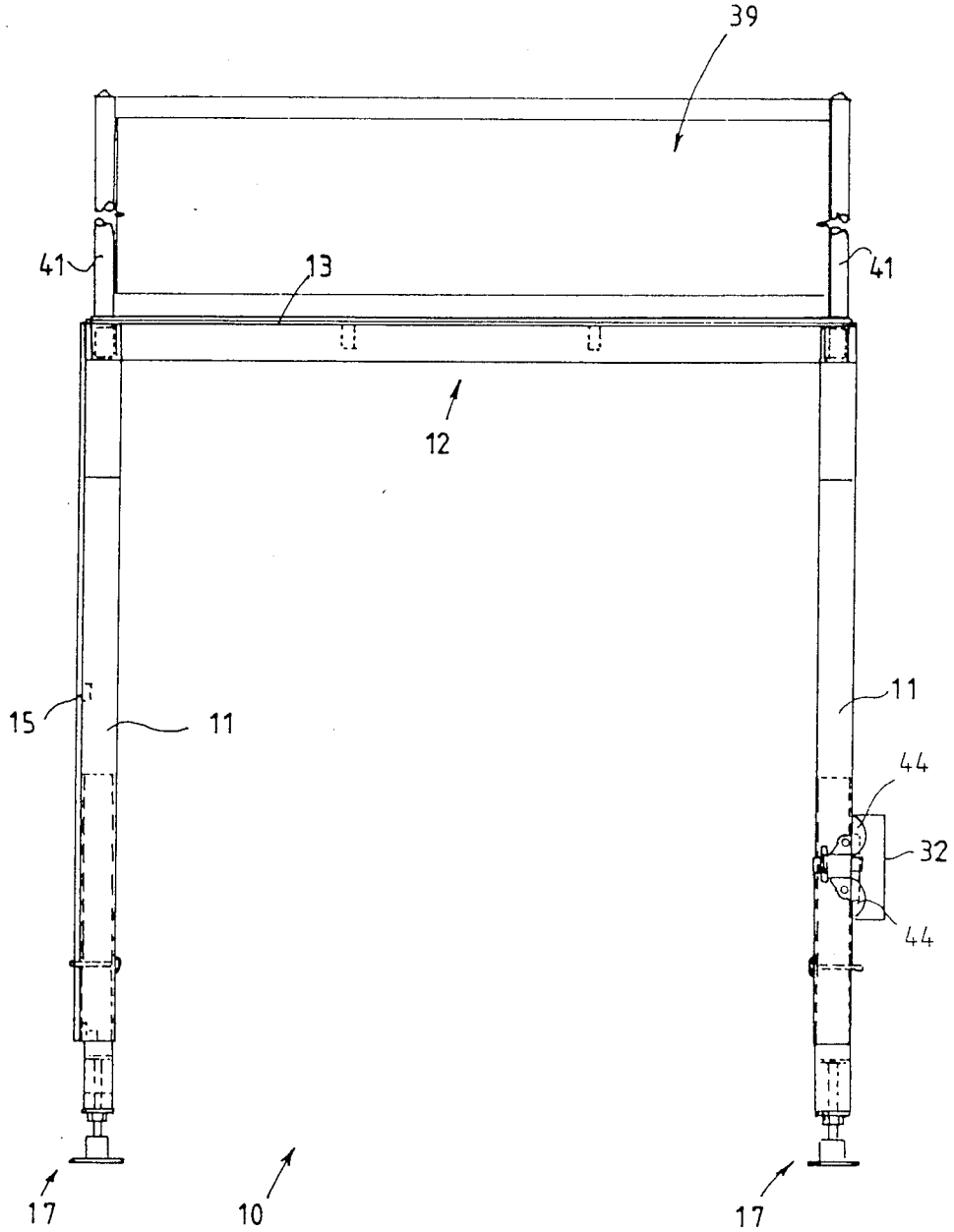
FIG. 3 is a sectional view along line A—A of FIG. 1.

Referring to the drawings and firstly to FIGS. 1 to 3, there is illustrated a scaffolding module 10 according to a preferred form of the present invention. The module in this instance is of generally rectangular form and includes four upright preferably hollow rectangular cross sectioned support members 11 at the corners thereof which support at their upper end a deck framework 12 which is covered by a sheeting material 13 such as steel sheet or the like. Preferably suitable bracing 14 is provided at the upper ends of the support members 11 to provide stability to the module 10. The operative rear wall of the module is also closed in by sheeting 15 such as steel sheeting which may be supported by a central bracing member 16 extending between the rear upstanding support members 11.

Each upstanding support member 11 is provided at its lower end with an adjustable foot assembly 17 each of which may be adjusted to support the module 10 in a required attitude and which are preferably arranged to compensate for variations in or undulations in the surface such as a footpath surface upon which the modules are to be supported.

Figure 4:
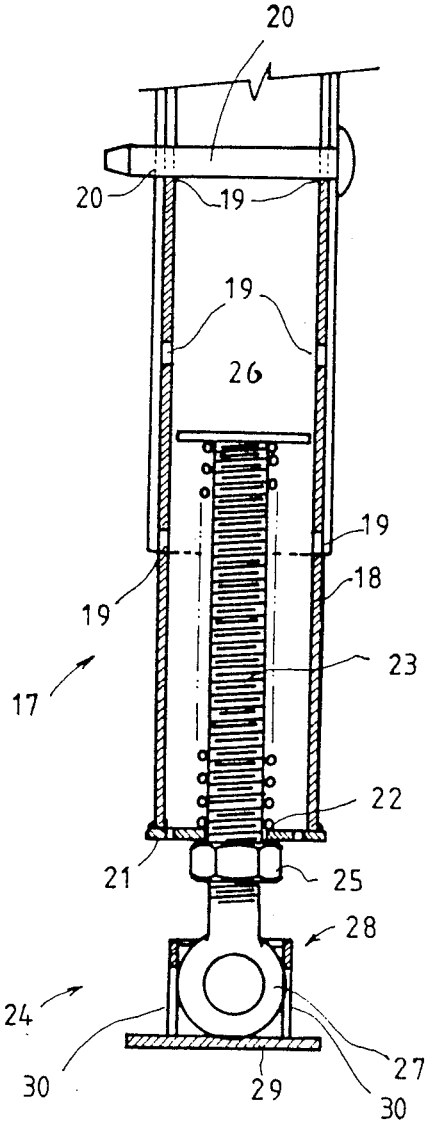
FIG. 4 is a sectional elevational view of one form of support foot assembly for the gantry upstands.
Figure 5:
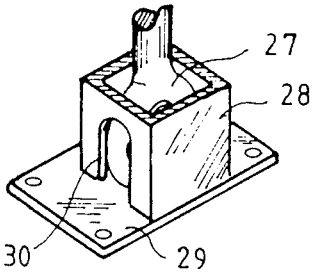
FIG. 5 is a perspective view showing an end portion of the foot assembly of FIG. 4.

In one form, each foot assembly 17 may be in the form shown in FIGS. 4 and 5 and include a first hollow member 18 telescopically receivable within the lower end of the support member 11 and provided with a plurality of spaced apertures 19 therein which may be aligned with a pair of apertures in the opposite sides of the support member 11 so that a locking pin or member 20 may be passed therethrough so that the hollow member 18 is maintained in a fixed position relative to the end of support member 11. This adjustment of course may be varied by removing the pin 20 and repositioning the hollow member 18 until a further pair of its apertures 19 are aligned with the apertures 20 of the support member 11. This therefor provides for a course adjustment of the length of the support member 11. The lower end of the hollow member 18 is provided with an end cap or plate 21 provided with an aperture 22 thereon to receive therethrough the threaded shank 23 of the support foot 24 in the manner illustrated. Plate 21 may be provided with a plurality of drainage holes. Fine adjustment of the foot 24 is achieved by means of a nut 25 threadely engaged with the shank 23 and normally in abutment with the end cap 21. Thus rotation of the nut 25 in opposite directions will cause inward and outward movement of the shank 23 relative to the hollow member 17 and thereby fine adjustment of the foot. Suitable abutment of the nut 25 with the cap 21 is maintained by means of a spring 26 surrounding the threaded shank 23 internally of the hollow member and interposed between the end cap 21 and an end plate 26 secured to the end of the threaded shank 18.

Figure 6:
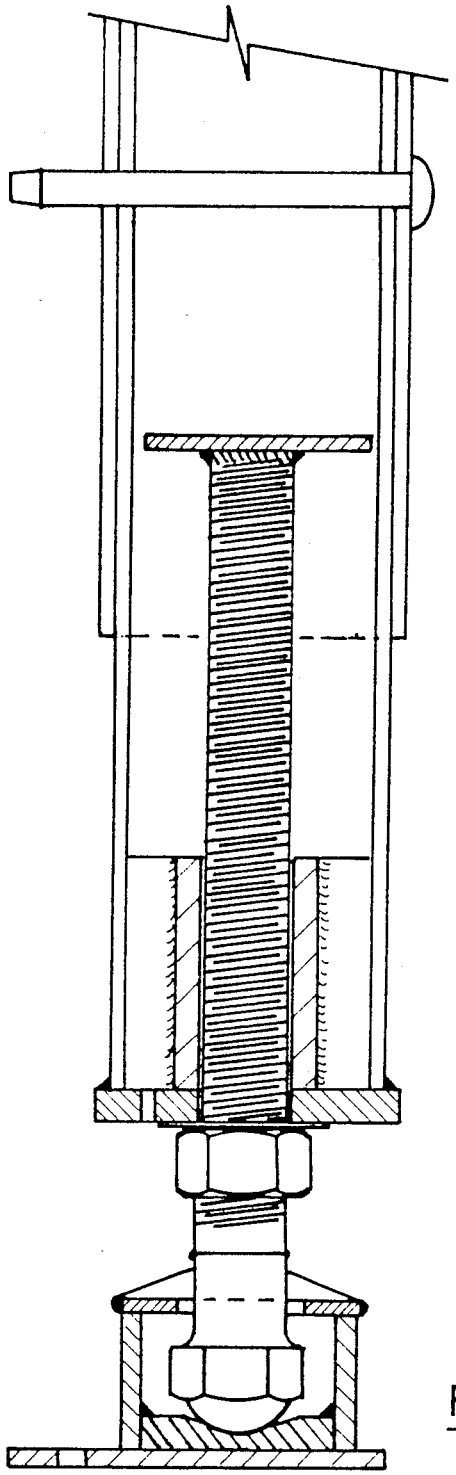
FIG. 6 is a section view of an alternative form of foot assembly.

The opposite end of the foot 24 is provided with a universal joint so that the foot may adopt any position to cater for variations in the underlying support surface. In the embodiment illustrated, the universal joint comprises an eye 27 at the end of the threaded shank received within a hollow housing 28 secured to a planar mounting foot 29. The hollow housing 28 is provided at its opposite sides with respective cut out portions 30 which are so sized and positioned as to captively hold the eye 27 within the hollow housing 28. The above described arrangement also permits easy cleaning of the housing 28 after use. This joint permits a sufficient degree of universal movement to cater for most variations encountered in the support surface for the gantry. Of course other suitable pivotal foot assemblies 17 may be employed for the support members such as a universal ball type joint as shown in FIG. 6.

Figure 7:
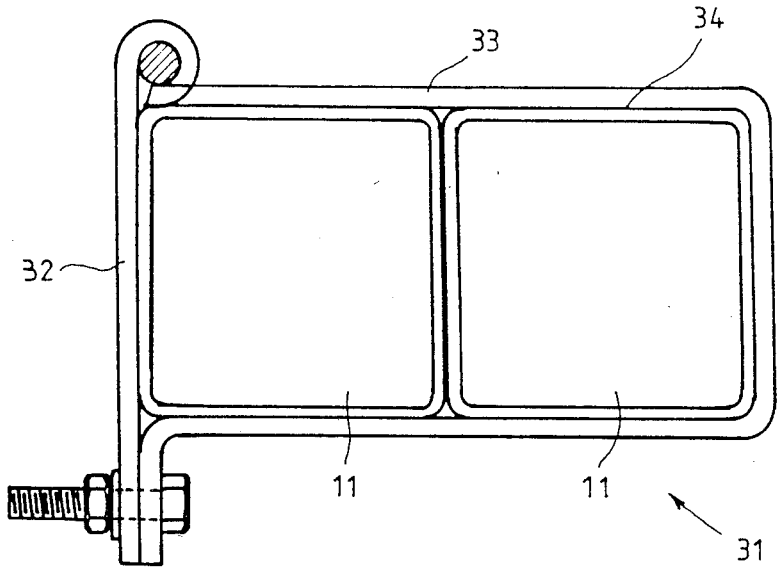
FIG. 7 is a plan view of a suitable clamp for use between adjacent gantry upstands.

The invention also provides a plurality of clamp assemblies which may be used to clamp together respective upright support members 11 of adjacent gantries. A suitable clamp assembly 31 for this purpose is shown in FIG. 7 and comprises a pair of hinged parts 32 and 33, one part 32 being of relatively planar form, the other part defining an elongated recess 34 which in use neatly receives a pair of support members 11. The respective parts may then be simply held together by bolting. Of course the support members may be simply bolted together by means of bolts passing through aligned holes therein.

Figure 8:
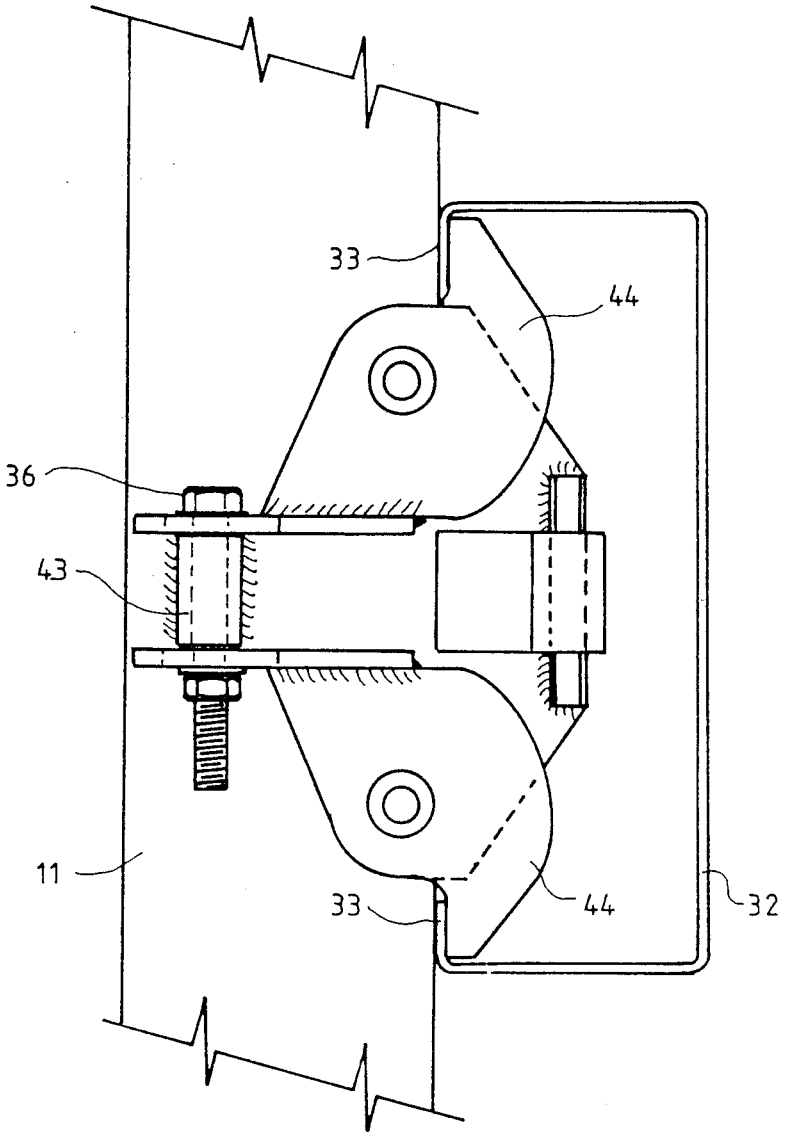
FIGS. 8 and 9 illustrate respective elevational and plan views of a side rail connector for the gantry assembly.
Figure 9:
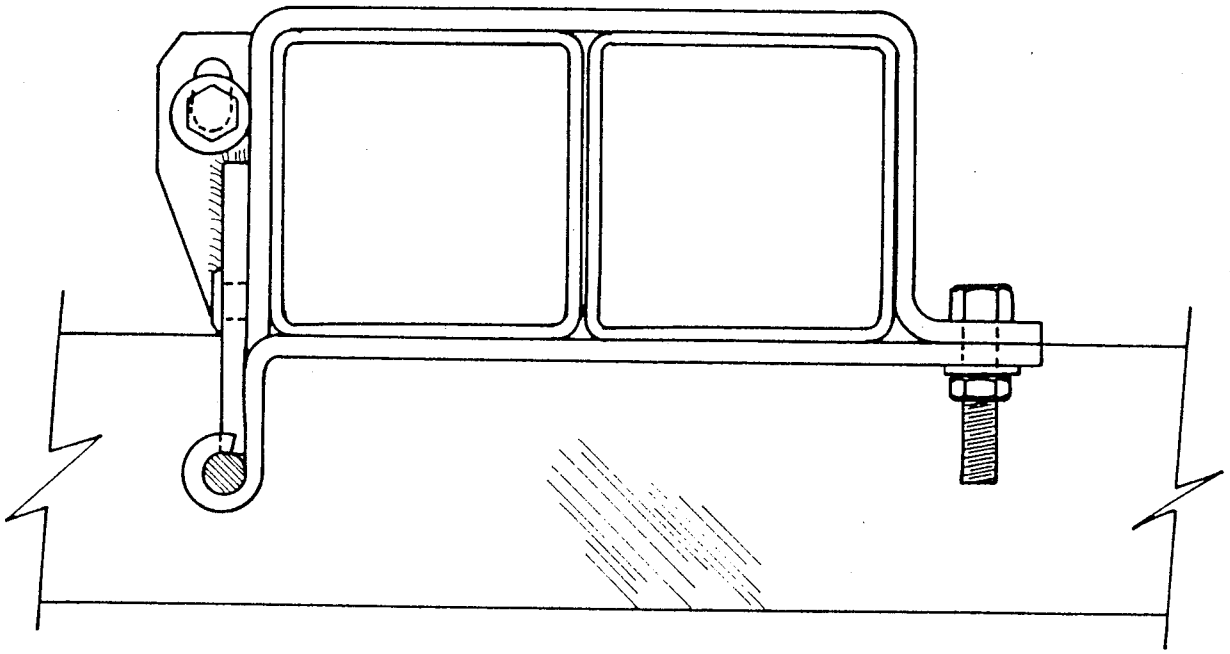
Figure 10:
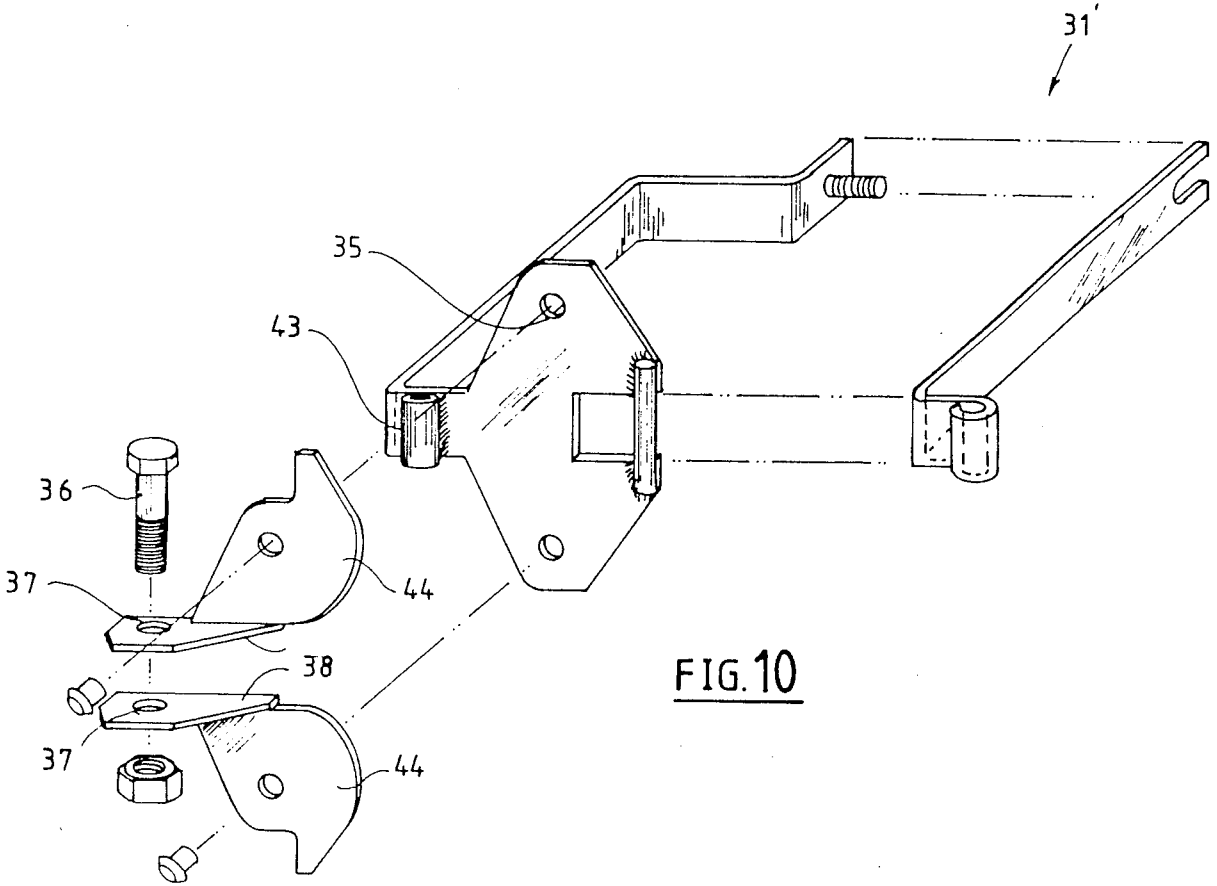
FIG. 10 is an exploded view of the side rail connector of FIGS. 8 and 9.

In an alternative form the clamps 31' may also be provided with means for engaging and retaining side rails 32 for the gantries and a suitable form for such retaining means is shown in FIGS. 8 to 10. Normally side rails 32 are attached to a gantry 10 intermediate the ends of the upstanding support members 11 for pedestrian safety purposes and as used in the present instance are preferably of C shape cross-section form. The means for engaging and retaining the side rails in this instance are operative to clamp the free flange ends 33 of the C-shaped rails to the upstands 11 and for this purpose the retaining means comprise a pair of jaws 44 pivotably mounted on a support plate 35 forming part of the support member clamp 31' and being pivotal from an engaged position shown in FIG. 8 to a disengaged position whereby the side rails 32 may be detached.

Preferably means are provided to urge the jaws 44 to an operative retaining attitude and in this instance such means comprise a bolt 36 which is passed through apertures 37 formed in ears 38 comprising extensions of the jaws. The bolt 36 may simply be tightened to pivot the ears 38 towards each other and cause corresponding opposite pivotal movement of the jaws 44 to a rail retaining and clamping attitude. In an alternative configuration one of the ears may be provided with a threaded stud which is passed through an aperture 37 in the other ear to be engaged by a nut.

In a further alternative, support plate 35 has welded thereto a tubular section 43 which in use aligns with through apertures 37. In this embodiment ears 38 are clamped by bolt 36 in abutting relationship with tubular section 43. In a still further embodiment (not shown) utilising tubular section 43 the portion of jaws 44 contacting the free flange ends 33 of the C-shaped rails may be angled towards and in some cases past the edge of upstand 11 when the ears 38 are in operative abutment with tubular section 43 to provide additional frictional holding of the C-channel side-rails 32 when operatively engaged.

The gantry modules may also be provided with detachable top rails 39 which serve as a railing for persons walking or moving about the deck 13. For this purpose the upper ends of the support members 11 may be provided with sockets 40 which may simply receive the spigot ends of upstanding supports 41 for the top rails 39. Where a plurality of scaffolding modules are arranged side by side a pair of adjacent top rails 39 may be interconnected by a U-shaped member 42 in the manner shown in FIG. 1.

Figure 11:
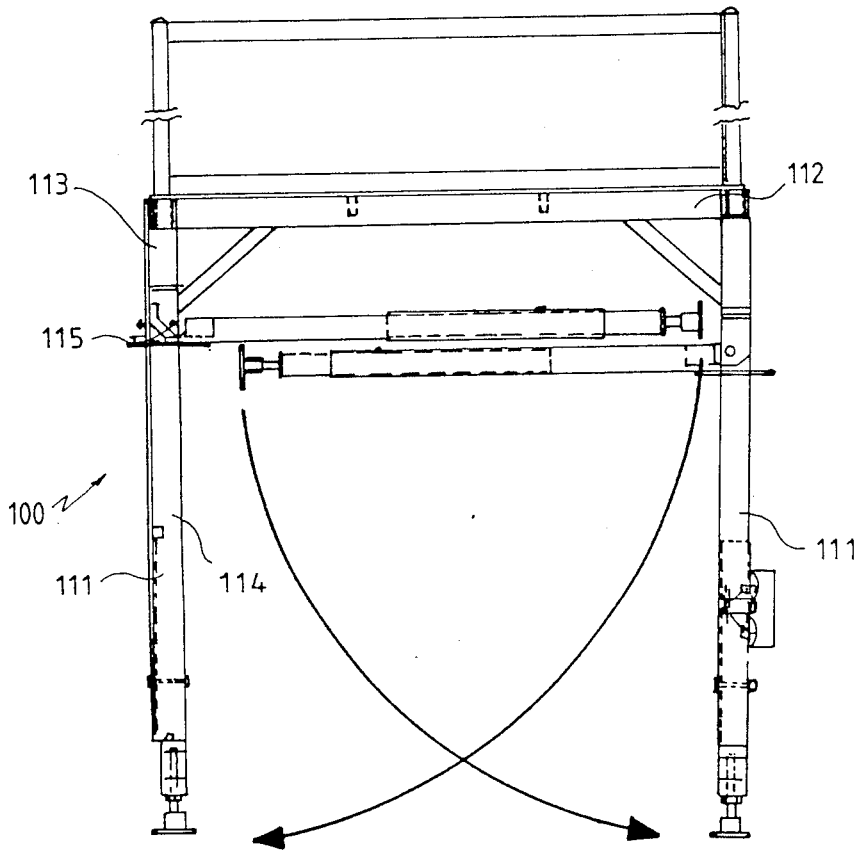
FIG. 11 is an elevation view illustrating a foldable gantry module constructed in accordance with the present invention.

Referring to FIG. 11, there is illustrated a gantry module 100 including upstanding support members or legs 111 and roof assembly 112. Each leg 111 includes an upper fixed portion 113 and a lower folding portion 114. The lower folding portion 114 is hingedly attached to the portion 113 about a hinge 115. Hinge 115 is preferably arranged so as to prevent folding portion 114 from folding outwardly from its position of alignment with fixed portion 113.

As illustrated in FIG. 11, the folding portions 114 are illustrated in their operatively folded and unfolded attitudes. The folding portions 114 may be suitably secured in their unfolded and folded attitudes.

It will be clear that by providing a foldable gantry module of the type illustrated in FIG. 11, that a number of gantry modules may be stacked for transport to the site of building construction or demolition. Substantial spacial saving may be accomplished in transport of gantry modules by using the embodiment of FIG. 11 but it will be realised that many other embodiments may be used.

In use a plurality of scaffolding modules 10 (or 100, FIG. 11) may be simply delivered to site with the required course adjustment of the foot assemblies 17 preferably made prior to delivery thereof. The modules 10 are arranged in end to end relationship and interconnected by clamps of the type shown in FIG. 7 or alternatively connected by bolting whilst fine adjustment of the foot assembly 17 may be carried out by adjustment of the nuts 15. The support plates 29 are of course in conventional manner mounted on lengths of timber arranged along say a footpath and secured thereto by any suitable fasteners passed through apertures therein. The side rails 32 may be then simply assembled and clamped to the support members 11 and the top rails 39 engaged in the manner described above.

The above procedures result in a scaffolding gantry which may be assembled in rapid time compared to the conventional assembly and therefor result in a saving in foot path hiring costs and labour costs for erection. Furthermore, as few components are involved little or no loss of such occurs.

Of course the gantry module described above may be of any physical dimensions and of alternative forms to that described. It will also be realised that many other forms of foot assembly may be employed to provide a pivotal mount to cater for footpath undulations.

Whilst the above has been given by way of illustrative example of the invention, it will be realised that many modifications and variations may be made to the above described embodiment by persons skilled in the art without departing from the broad scope and ambit of the invention as herein set forth and as defined in the accompanying claims.

I claim:

1. A gantry module of generally rectangular form for use in constructing a gantry on a footpath or the like, said module comprising four legs, a roof assembly secured to and supported by said legs, means for changing the length of each said leg, each said leg defining a corner of the module and including a foot assembly, means pivotably mounting a foot assembly to each said leg to suit varying footpath undulations and heights, each said leg including a hinge means located between said foot assembly and said roof assembly for folding said legs about their respective hinge means, at least one said hinge means being offset relative to each other hinge means to enable said legs to foldably overlap.

2. A module as defined in claim 1 wherein each said leg includes an upper portion secured to said roof assembly and a lower portion, said lower portion being telescopically slidable relative to said upper portion.

3. A module as defined in claim 2 wherein each said foot assembly further comprises a threaded rod and a base plate, said threaded rod having an upper leg engaging end and a lower housed end, said upper end being retained in said leg, the height of said leg being adjustable by upward or downward movement of said rod, a housing means attached to said base plate, said housed end being housed in said housing means and including a pivotal surface to enable pivoting of said base plate relative to said leg.

4. A clamp for use in a gantry assembly of the type including a plurality of side by side gantry modules, each said gantry module comprising a plurality of legs and a roof assembly secured to said legs, said clamp comprising a primary clamp and a secondary clamp, said primary clamp including a substantially U-shaped strap, said U-shaped strap having a closure strap hingedly connected to one of its free ends, means for releasably securing the closure strap to the other free end of said U-shaped strap and for operatively clamping a plurality of the legs in side by side relationship between said U-shaped strap and said closure strap means on said secondary clamp for clamping an elongate member transverse to and against said clamped legs, said secondary clamp being integral with said primary clamp and including two pivoting members, said pivoting members being pivotable about axes transverse to the elongate axis of said clamped legs, each said pivoting member having clamping jaws adapted to independently pivot from a an elongate member clamping attitude wherein said elongate member is clamped against said clamped legs to a an elongate member release attitude.

5. A modular gantry assembly for use on a pavement or the like, said gantry assembly comprising a plurality of juxtaposed independent gantry modules, each said gantry module being movable as a rigid unit and comprising, a plurality of spaced legs, a roof assembly supported by the legs, said roof assembly having a roof panel extending between the upper ends of the legs, a side wall between adjacent legs and extending from an edge of the roof assembly to adjacent the lower ends of said adjacent legs, a pedestrian passageway extending through each said module adjacent said side wall and beneath said roof panel, said roof assembly and said side wall being aligned with a roof assembly and side wall of a continguous module to form an extending roof assembly and side wall for said gantry.

6. A gantry as defined in claim 5 wherein each said roof assembly is formed as an integral construction including the roof panel and respective upper leg portions, said upper leg portions being rigidly secured to said roof panel at one end and rigidly secured to a lower leg portion at the other end thereof to thereby form each said leg.

7. A gantry as defined in claim 5 or claim 6 wherein each said leg includes a foot assembly, and means pivotally connecting a foot assembly to each said leg to suit varying pavement undulations and heights.

8. A gantry as defined in claim 6 wherein each said module is generally rectangular in plan and includes a hand rail extending along a side opposite said side wall and means are provided to change the length of the legs.

9. A gantry as defined in claim 8 wherein said module includes a detachable hand rail engaged in said roof assembly and extending above and along a side of the roof assembly.

10. A gantry module for use in the construction of a gantry assembly from a plurality of said modules on a pavement or the like for the protection and unimpeded passage of pedestrians along the pavement, said module comprising a plurality of spaced legs, a roof assembly, means for securing the roof assembly to the legs so that the legs support the roof assembly, each said leg having a foot assembly, said roof assembly having a roof panel extending between the upper ends of the legs, a side wall between adjacent legs and extending from a location adjacent their respective foot assemblies up to the roof assembly, a pedestrian passageway extending through the module adjacent the side wall and beneath the roof panel, said module in use being independently movable relative to adjacent modules to align the adjacent roof assemblies and side walls to thereby align respective passageways to provide a continuous passage for pedestrians from module to module.

11. A gantry module as defined in claim 10 wherein the roof assembly is formed as an integral construction including the roof panel and respective upper leg portions, each said upper leg portion being rigidly secured to said roof panel at one end and being rigidly securable to a respective lower leg portion at the other end to thereby form each said leg.

12. A gantry module as defined in claim 11 wherein means are provided for changing the length of the legs.

13. A gantry module as defined in claim 10 or claim 11 further including mounting means on said module for detachably receiving a hand rail.

14. A gantry module as defined in claim 10 wherein means mount each said foot assembly pivotably to a leg to account for surface undulations in said pavement.

* * * * *